US008915385B2

(12) United States Patent
Hansson et al.

(10) Patent No.: US 8,915,385 B2
(45) Date of Patent: Dec. 23, 2014

(54) SHOCK-ABSORBING COUPLER HEAD FOR A COUPLING ARRANGEMENT

(75) Inventors: Johan Hansson, Stora Skedvi (SE); Mattias Hjort, Hedemora (SE); Fredrik Hiswåls, Falun (SE); Daniel Larsson, Borlänge (SE); Anders Svedbo, Stora Skedvi (SE); Anders Westman, Falun (SE)

(73) Assignee: Ego International B.V., Brussels (BE)

( * ) Notice: Subject to any disclaimer, the term of this patent is extended or adjusted under 35 U.S.C. 154(b) by 166 days.

(21) Appl. No.: 13/805,537

(22) PCT Filed: Jun. 8, 2011

(86) PCT No.: PCT/SE2011/050706

§ 371 (c)(1), (2), (4) Date: Jan. 16, 2013

(87) PCT Pub. No.: WO2011/162674

PCT Pub. Date: Dec. 29, 2011

(65) Prior Publication Data

US 2013/0105431 A1 May 2, 2013

(30) Foreign Application Priority Data

Jun. 23, 2010 (SE) ..... 1050678

(51) Int. Cl.

*B61G 7/14* (2006.01)
*B61G 3/16* (2006.01)
*B61G 11/16* (2006.01)

(52) U.S. Cl.

CPC *B61G 7/14* (2013.01); *B61G 11/16* (2013.01); *B61G 3/16* (2013.01)
USPC ..... 213/75 R; 213/179

(58) Field of Classification Search

CPC ..... B61G 3/16; B61G 7/14; B61G 11/16; B61D 15/06
USPC ..... 213/75 R, 179
See application file for complete search history.

(56) References Cited

U.S. PATENT DOCUMENTS 2,161,724 A * 6/1939 Scharfenberg ..... 213/77
4,576,294 A * 3/1986 Forster ..... 213/9

(Continued)

FOREIGN PATENT DOCUMENTS

CN 1842458 A 10/2006
CN 101553390 A 10/2009

(Continued)

OTHER PUBLICATIONS

International Search Report, dated Sep. 13, 2011, from corresponding PCT application.

(Continued)

*Primary Examiner* — Zachary Kuhfuss
(74) *Attorney, Agent, or Firm* — Young & Thompson

(57) ABSTRACT

A coupler head for a coupling arrangement is shown, which coupler head includes a coupler head housing (6) extending in a longitudinal direction from a first end (6*a*), attachable to a drawbar, to a second end (6*b*), which is arranged to carry a coupling interface between coupled rail vehicles, which coupler head housing houses mechanical coupling components (8,9) effective for automatic coupling to the corresponding components of a connecting coupling arrangement. The coupler head is characterized in that the coupler head housing has at least one notch (11, 11') for a predetermined and primarily axial compression thereof with absorption of energy from a deforming compressive force that is applied to the coupler head in the longitudinal direction thereof. The coupler head has preferably at least one notch (11, 11') for a predetermined folding of the coupler head housing.

20 Claims, 5 Drawing Sheets

(56) References Cited

U.S. PATENT DOCUMENTS

| | | | | |
|---|---|---|---|---|
| 6,499,613 | B1 * | 12/2002 | Grau et al. | 213/7 |
| 2007/0187350 | A1 | 8/2007 | Kontetzki | |
| 2008/0156762 | A1 * | 7/2008 | Seitzberger et al. | 213/76 |
| 2008/0277366 | A1 * | 11/2008 | Kemper | 213/75 R |
| 2009/0000506 | A1 | 1/2009 | Jaede | |

FOREIGN PATENT DOCUMENTS

| | | | |
|---|---|---|---|
| DE | 1124535 | B | 3/1962 |
| DE | 102004045737 | A1 | 3/2006 |
| EP | 1 312 527 | A1 | 5/2003 |
| EP | 1 663 755 | B1 | 6/2006 |
| EP | 1663755 | B1 | 3/2009 |
| SU | 662396 | A1 | 5/1979 |
| WO | 0005119 | A1 | 2/2000 |
| WO | WO 2011162671 | A1 * | 12/2011 |
| WO | WO 2011162672 | A1 * | 12/2011 |
| WO | WO 2011162673 | A1 * | 12/2011 |

OTHER PUBLICATIONS

English translation of Chinese Office Action, dated Oct. 15, 2014, from corresponding CN application.

* cited by examiner

Fig. 7
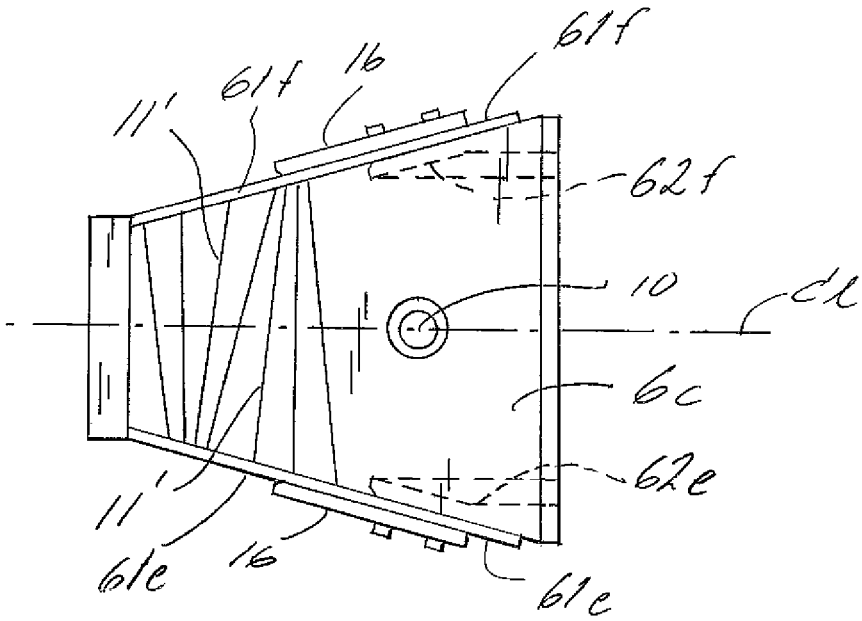
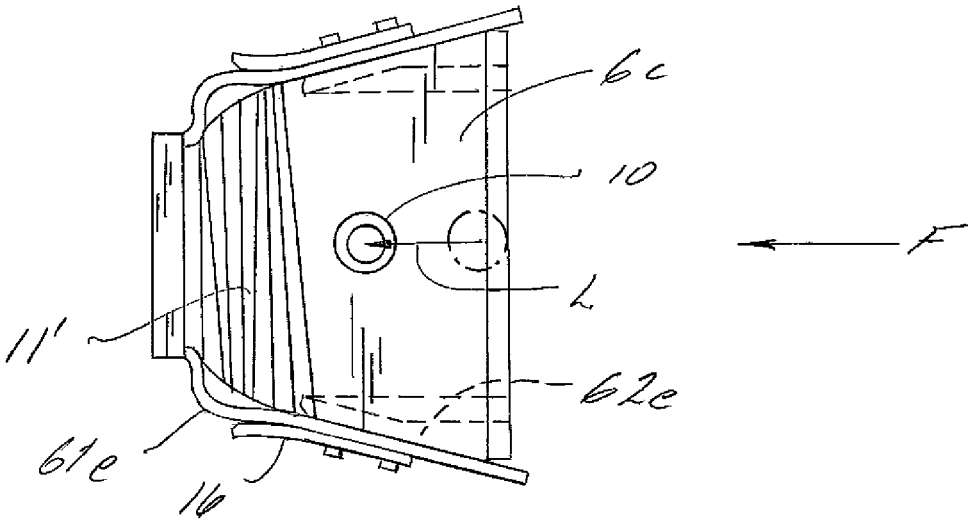
Fig. 8

Fig. 9a
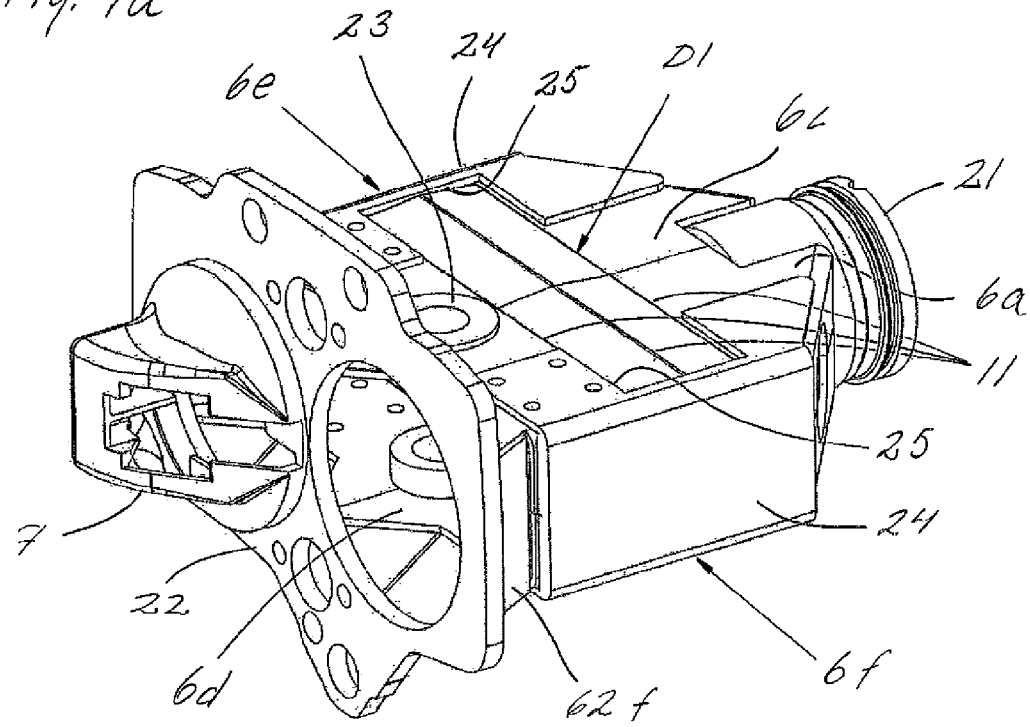
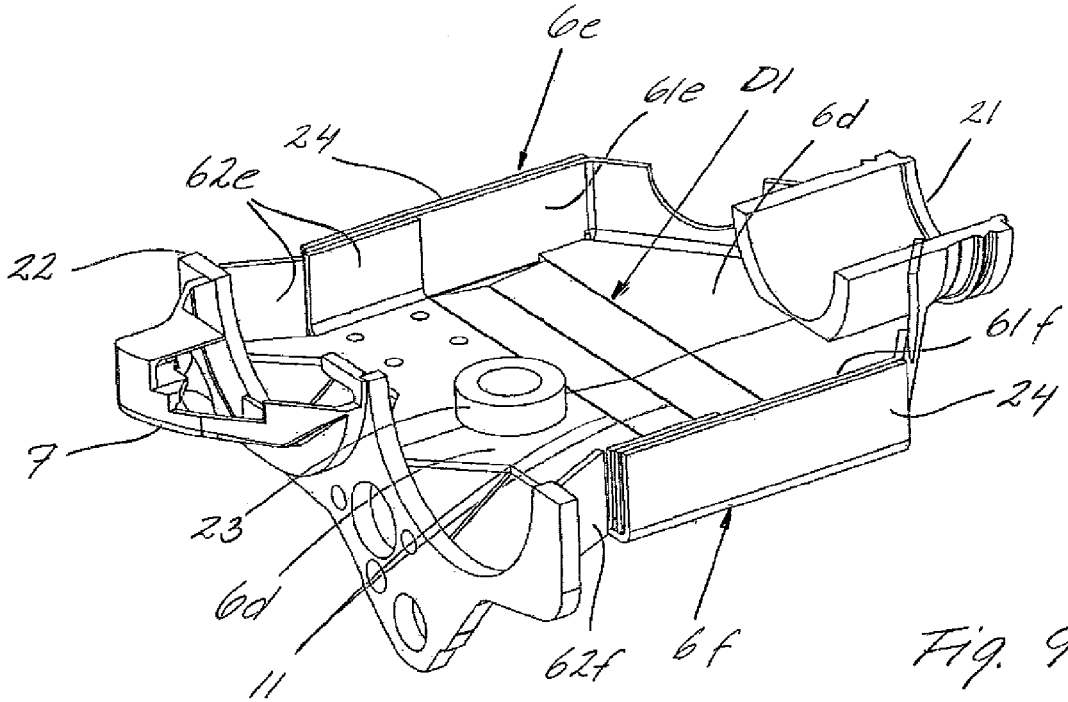
Fig. 9b

SHOCK-ABSORBING COUPLER HEAD FOR A COUPLING ARRANGEMENT

TECHNICAL FIELD OF THE INVENTION

The invention concerns a coupler head intended for a coupling arrangement and having a coupler head housing extending in a longitudinal direction from a first end, attachable to a drawbar, to a second end, which is arranged to carry a coupling interface between coupled rail vehicles, which coupler head housing houses mechanical coupling components arranged for automatic coupling to the corresponding components of a connecting coupling arrangement.

BACKGROUND AND PRIOR ART

Shock-absorbing devices in rail vehicles are previously known in the form of, for instance, deformable brackets for the mounting of buffers on a car chassis, see, e.g., DE 10 2004 045 737 A1, WO 00/05119 A1, US 2009/0000506 A1.

Different solutions are also previously known for the absorption of energy in a coupling arrangement between rail vehicles. These solutions comprise, as an example, shock-absorbing elastic damping devices introduced in the coupler, but also devices that are arranged to be plastically deformed in the event of a collision, in the conversion of at least a portion of the generated force into kinetic energy and heat. These latter devices are typically made in the form of radially expanding or compressible deformation tubes that can be introduced in the drawbar or in the mounting area of the coupler in a car chassis. As an example of the latter, EP 1 312 527 A1 or EP 1 663 755 B1 could be pointed out.

The coupler head of an automatic coupler, which in a surrounding housing accommodates the mechanical coupling components necessary for coupling for automatic coupling to a meeting coupler, is usually made of castings and lacks typically shock-absorbing measures. A coupler head housing made of weldable forged steel for a central buffer coupling is, however, previously known from DE 1 124 535. This coupler head housing is dimensioned to resist occurring normal traction and thrust forces, but lacks measures for shock-absorbing deformation.

BRIEF SUMMARY OF THE INVENTION

The invention aims at generally increasing the capability of a coupling arrangement of absorbing energy, in particular energy arising from forces generated in a collision, and thereby providing an increased protection against deformation of the car chassis.

Therefore, an object of the invention is to provide a coupler head for an automatic coupler, which coupler head is arranged to be plastically deformed while absorbing energy.

Another object of the invention is to provide a shock-absorbing coupler head in which a predetermined deformation is locally limited to leave the bearing area of the accommodated coupling components in the same unaffected in the course of deformation.

Still another object of the invention is to provide a shock-absorbing coupler head in which a deformation resistance can be maintained in a controllable course of deformation.

An additional object of the invention is to provide a shock-absorbing coupler head in which the deformation is predetermined to provide a locking of accommodated mechanical coupling components in the coupled state.

In accordance with the present invention, there is provided a coupler head intended for a coupling arrangement and comprising a coupler head housing extending in a longitudinal direction from a first end, attachable to a drawbar, to a second end, which is arranged to carry a coupling interface between coupled rail vehicles, which coupler head housing houses mechanical coupling components effective for automatic coupling to the corresponding components of a connecting coupling arrangement. According to the invention, the coupler head housing is made with a notch for a predetermined and primarily axial compression thereof with absorption of energy from a deforming compressive force that is applied to the coupler head in the longitudinal direction thereof.

Initially, it should be explained that, by the expression predetermined deformation, reference is made in the following description to an essentially axial compression according to a course of deformation that is controlled by constructional measures or design measures taken in the coupler head. The measures suggested according to the present invention consist in particular of one or more notches for a predetermined folding of the coupler head housing.

It will be appreciated by a person skilled in the art that such a controllable deformation only can be expected in connection with forces up to a certain magnitude, while forces exceeding this magnitude result in a no longer predictable deformation. The object of the invention is, however, still achieved, because the energy that is dissipated during the controllable deformation implies a corresponding reduction of the initial deformation force. In combination with other shock-absorbing devices, known per se, in the coupler, such as deformation tubes and elastic damping members in the mounting area of the coupler, the invention implies that more energy can be absorbed before the car chassis is affected by a deforming force.

The coupler head is preferably made from steel, the elasticity and ability of the steel to be plastically deformed when subjected to loads above its yield point being utilized to convert a collision force into kinetic energy and heat. In particular, it is envisaged that the coupler head housing or at least parts thereof can be made from a high-strength steel, such as an advanced high-strength steel or a steel having extra high or ultra high strength, whereby the required strength to resist normal traction or thrusts occurring during operation can be provided also in a coupler head of reduced weight.

The coupler head in an automatic coupler for rail vehicles carries, among other things, mechanical coupling components, which typically are supported inside the coupler head housing behind a front plate. In many cases, it is desirable that these components remain in the coupled state after a collision. Therefore, a preferred embodiment of the invention prescribes that said at least one deformation notch defines a primary deformation zone situated behind the bearing of the mechanical coupling components in the coupler head housing, as seen in the direction from the coupler head toward the car chassis. Hereby, it is guaranteed that the coupling interface and the coupling engagement remain intact after deformation, at least in connection with deformation forces that in their entirety can be absorbed in a controllable course of deformation.

In an alternative embodiment, a secondary deformation zone may in addition be arranged in front of the bearing of the mechanical coupling components in the coupler head housing, as seen in the direction from the coupler head toward the car chassis. Said secondary deformation zone is preferably defined by an additional deformation notch, which is made in such a way that a greater deformation force is required to initiate a compression of the secondary deformation zone, than the corresponding requisite deformation force for the compression of the primary deformation zone. In this way, an increased shock-absorbing capability of the coupler head is provided also in connection with deformation forces of a magnitude that exceeds the energy absorbed in a controllable course of deformation with a guaranteed engagement between the couplers.

The coupler head housing may be compared to a hollow body and may have an essentially four-sided or rounded cross-section. The coupler head housing is suitably constructed of two or more shell parts assembled by welding and/or screw fitting, and has typically an upper part and a lower part/bottom essentially uniform with the same, which are interconnected by means of a respective side portion. The side portions may consist of separate elements, but may alternatively be parts integrated with the upper part and the bottom, respectively. The shell parts of the coupler head housing may, for instance, be formed by cutting and bending and/or compression-moulding.

In that connection, the deformation notch/notches are preferably uniformly made at least in the upper part and bottom of the coupler head housing.

Deformation notches may advantageously be applied in the upper part and the bottom as well as in the sides of the coupler head housing so as to form a deformation zone surrounding the coupler head housing. In this embodiment, the deformation zone may be made of a compression-moulded steel plate blank, which then is introduced in the coupler head housing.

For increased axial stiffness of a front part of the coupler head housing, in which the coupling components are supported, the sides of the coupler head housing may be arranged to run divergingly from the deformation zone toward a front plate carried in the front end of the coupler head housing.

The deformation notch is suitably made in the form of a relative weakening that is locally applied in the coupler head housing and that may be provided by methods known per se and comprise one or more of the measures bending, milling, hole making, variation of material thickness, adding of a locally limited hardening, a combination or combinations of different materials, material composition, addition or removal of material, etc.

In one embodiment, the deformation notch is arranged to trigger an axial compression of the coupler head housing that is symmetrical in horizontal and vertical planes. In this case, the deformation notch is preferably symmetrically arranged in the coupler head housing, for example, in the form of a relative weakening introduced in the structure of the coupler head housing, the extension of which weakening is uniformly distributed on each side of an axial centre line through the coupler head housing.

In an alternative embodiment, the deformation notch is arranged to trigger a compression of the coupler head housing that is symmetrical in vertical planes but oblique or asymmetrical in horizontal planes. In the latter case, the deformation notch is preferably asymmetrically arranged in the coupler head housing, for example, in the form of a relative weakening introduced in the structure of the coupler head housing, the principal extension of which weakening is situated beside the axial centre line through the coupler head housing. In particular, according to this alternative embodiment of the invention, it is taught that the deformation notch defines a deformation zone having a horizontal extension diverging toward one side of the coupler head housing.

An asymmetrical compression of the coupler head can afford an increased deformation distance without the coupling between the coupling arrangements being released, because the coupling components can remain in engagement also when the same upon deformation are displaced in the direction of opposite sides of the axial centre line through the coupler head housings.

In a symmetrically deformable coupler head housing, the deformation zone may alternatively be limited by two juxtapositionly running, opposed and uniform deformation notches, each one of which has an extension diverging toward the respective side of the coupler head housing.

It is furthermore advantageous and in many cases preferred that at least the primary deformation zone of the coupler head housing is defined by a deformation notch that, when compressing the coupler head housing, creates a predetermined deformation, which results in the mechanical coupling components actively being locked in a coupled state. This result may meritoriously be provided in an asymmetrically deformable coupler head housing, wherein the mechanical coupling components are moved by the deformation toward an area of one side of the coupler head housing and this side is arranged to provide an obstacle for the release of the coupling, in particular a mechanical stop against rotation of a central plate, which typically is included as a part of a coupling mechanism in automatic couplers for rail vehicles.

According to a preferred embodiment of the invention, the coupler head housing comprises means for providing an added deformation resistance after the threshold value of a permanent deformation of the material in the coupler head housing having been exceeded. Said means may, in its primary embodiment, consist of a relative strengthening introduced in the structure of the coupler head housing, which alternatively may be applied only in one side of the coupler head housing so as to allow an asymmetrical compression, or alternatively in both sides for a symmetrical compression of the coupler head housing. The strengthening may, for example, be realised in the form of bending of the side portion, or by a material thickness varied locally in the side portion.

In particular, it is preferred that the coupler head housing comprises at least one side consisting of at least two individual side portions, which in an overlapping area are interconnected by means of a mechanical fitting, and which side portions in the course of deformation mutually are displaced while overcoming a prestressing force in the joint. Said side of the coupler head housing may comprise a front side portion connecting to the front part of the coupler head and a rear side portion, respectively, connecting to the rear part of the coupler head.

In that connection, it is extraordinarily advantageous if the connection between the mutually movable side portions is made as a bolt joint and comprises a number of bolts that are stationary supported in a first side portion, for engaging, via long holes or slots formed in an overlapping second side portion, with a thrust plate, by means of which the overlapping areas of the first and second side portions are pressed together by tightening of the bolts. By the number of the bolts and dimensioning of tightening torque, in this embodiment, a means is provided of regulating the clamping force of the joint and thereby affecting the size of a force acting to retard the relative motion of the side portions and the axial compression of the coupler head housing.

In order to affect the friction that is to be overcome in the bolt joint for relative motion between the side portions in the overlapping area, friction-increasing means may in addition be introduced between opposite surfaces of the side portions. Such friction-increasing means may be realised, e.g., in the form of a texture that is arranged in the surface of the first and/or second side portion and provides a cutting or planing effect, or a shear of the material, in the opposite surface. Such a texture may be more or less fine-grained, finely or coarsely toothed or wave-shaped, and may alternatively be formed on a separate plate introduced between the surfaces, for instance a plate buried in one of the surfaces.

BRIEF DESCRIPTION OF THE DRAWINGS

The invention will be elucidated below by embodiment examples and reference being made to the accompanying schematic drawings, of which

FIG. 7 shows in a horizontal view a third embodiment of a coupler head housing;

FIG. 8 shows the coupler head housing in FIG. 7 in compressed state;

FIG. 9*a* shows a preferred embodiment of a coupler head housing in a perspective view;

FIG. 9*b* shows the coupler head housing in FIG. 9*a* in an oblique cross-sectional view;

DETAILED DESCRIPTION OF EMBODIMENT EXAMPLES

Figure 1:
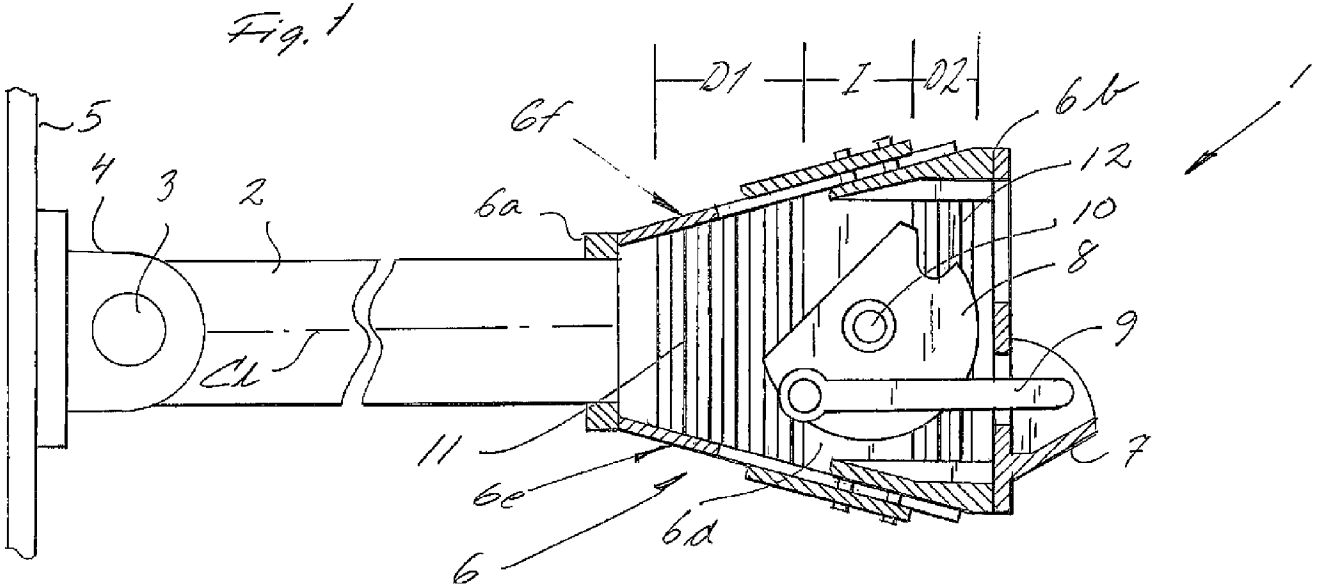
FIG. 1 shows a view from above of a partially broken-away coupling arrangement having a shock-absorbing coupler head.

It should be appreciated that the drawing figures are schematic and only suited to elucidate the general idea of the invention such as the same is seen in the written description and in the connecting claims. Therefore, the invention should not be considered limited to shown dimensions, geometries or to the embodiment of design details in the embodiment examples, because these have to be considered by a person skilled in the art in each individual application of the invention. In particular, it should be noted that material thicknesses and other dimensions may be over dimensioned and the constructive design of details simplified, for reasons of drawing technique.

Figure 2:
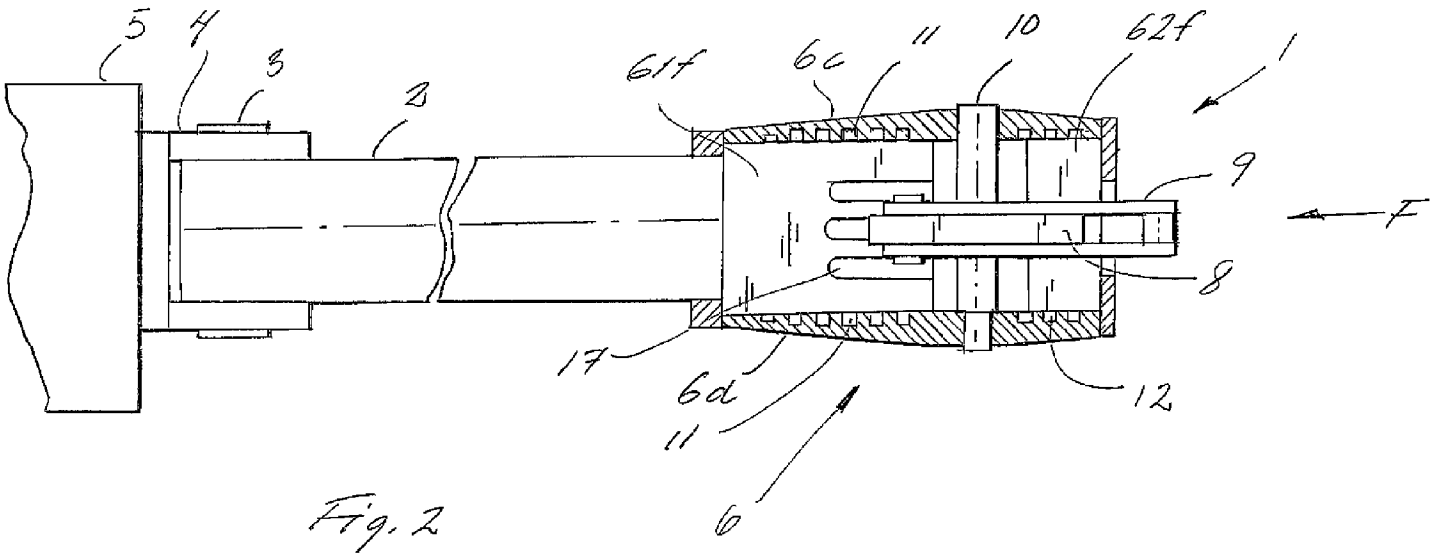
FIG. 2 shows the coupling arrangement in FIG. 1 in a partially broken-away side view.

The coupler head 1 is suitable to be included in a coupling arrangement schematically shown in FIGS. 1 and 2 and comprising a drawbar 2, which, via a swivel joint 3 and a bearing bracket 4, is articulately attached to a car chassis 5. The coupler head 1 comprises a coupler head housing 6, which in a rear part 6*a* has a first end that is attachable to the drawbar 2, and which in a front part 6*b* has a second end that is arranged for carrying necessary members, typically comprising a guide cone 7 for the alignment upon coupling to a corresponding coupling arrangement. Mechanical coupling components such as a central plate 8 and a coupling link 9 are housed in the coupler head housing and rotatably supported in the same around a pivot or shaft 10. Devices for the locking/unlocking of the coupling mechanism are for the sake of simplicity excluded from the drawing figures, as well as devices for the connection of electricity and pneumatics/hydraulics, which usually are carried on the outside of the coupler head.

The coupler head housing 6 has a box-shaped structure and consists of an upper part 6*c*, a bottom 6*d*, and two opposite sides 6*e* and 6*f*, respectively. The upper part and the bottom, as well as the two sides, are preferably mutually identically shaped with the exception of externally or internally arranged attachments and seats for the mounting of additional equipment. The parts of the coupler head housing consist, as previously mentioned, preferably of steel and are suitably assembled by welding and/or screw fitting.

In the upper part 6*c* and bottom 6*d* of the coupler head housing, at least one first deformation notch 11 is locally applied, delimiting a primary deformation zone D1 in the rear part of the coupler head housing. In the embodiment example according to FIGS. 1 and 2, the deformation notch 11 consists of grooves 11 formed on the inside, whereby a relative reduction of the strength of the upper part and the lower part has been locally created by removal of material. Alternatively, the corresponding deformation notch 11 may of course be applied in the outside of the coupler head housing, or both on the inside and outside of the same.

A second deformation notch 12 may correspondingly be applied for delimiting a secondary deformation zone D2 in the front part of the coupler head housing. Preferably, the deformation notch 12 is made in such a way that it results in a smaller reduction of the strength of the secondary deformation zone D2 that is smaller than the corresponding reduction of the strength of the primary deformation zone D1. This is illustrated in FIG. 2 by the grooves 12 having been formed with a smaller depth than the grooves 11. In particular, it should be noted that an area I between the primary and secondary deformation zones, in which area the mechanical coupling components are supported, is free from deformation notches and the strength thereof accordingly unaffected, and may even be strengthened, e.g., by a greater material thickness outlined in the drawing figure.

Here, it should be emphasized that the milled grooves 11 and 12 of the embodiment example only are an example of an embodiment of a deformation notch that is effective for triggering an essentially axial compression of the coupler head housing within a predetermined area D1 and/or D2 upon application of an abnormally high compressive force in the direction of the arrow F. Besides the previously mentioned alternative, an embodiment should particularly be pointed out wherein the coupler head housing at least partly consists of compression-moulded portions of steel or high-strength steel, wherein mouldings are made in such a way that the deformation is controlled and above all concentrated to a particular area of the coupler head housing.

Detached from said at least one deformation zone D1, the coupler head housing 6 may comprise means arranged for retarding the course of deformation. Said means may comprise mutually prestressed elements, which are effective for triggering an added resistance to compression of the deformation zone D1.

The coupler head housing of the embodiment example has sides 6*e* and 6*f*. Each of the sides 6*e*, 6*f* consist a first side portion 61*e*, 61*f*, in the embodiment example connecting to the rear part of the coupler head housing, and a second side portion, respectively, 62*e* and 62*f*, respectively, in the embodiment example connecting to the front part of the coupler head housing. Henceforth, reference is only made to the side 6*e*, because the side 6*f* in this embodiment example is a mirror-inverted counterpart to the side 6*e*.

Figure 3:
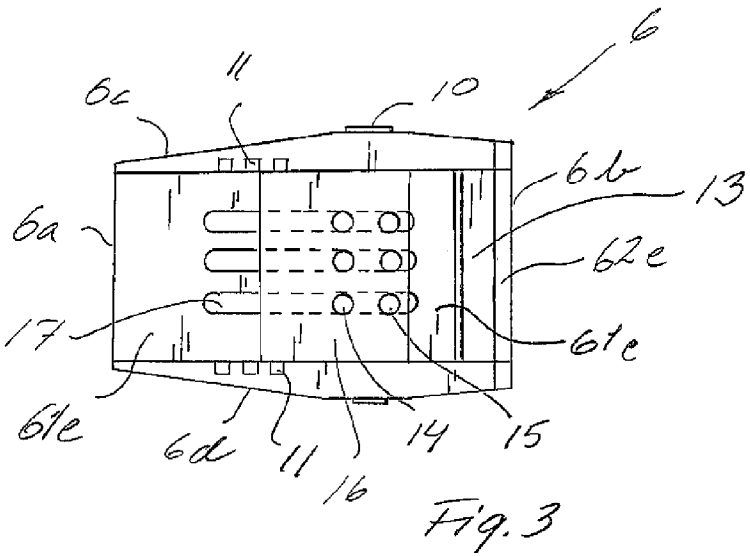
FIG. 3 shows a side view of the coupler head housing of the coupler head in FIGS. 1 and 2.
Figure 4:
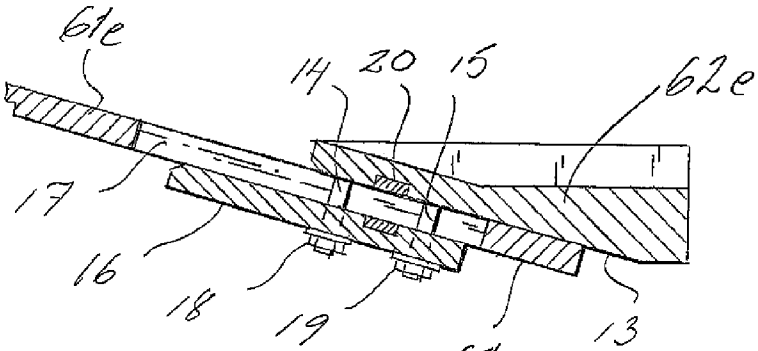
FIG. 4 shows on a greater scale a sectioned detailed view of the coupler head housing in FIGS. 1-3.

With particular reference to FIGS. 3-4, the front side portion 62*e* has an outwardly facing surface 13, against which an inwardly facing surface of the rear side portion 61*e* abuts in an overlapping relationship. Bolts 14 and 15 extend from the front side portion 62*e* through the rear side portion 61*e* into engagement with a thrust plate 16 that is arranged outside the rear side portion 61*e*. In that connection, the bolts 14 and 15 extend through an elongate slot 17 formed in the rear side portion 61*e*, which, upon tightening of the nuts 18 and 19, is clamped between the thrust plate 16 and the front side portion 62*e*. In this way, between the rear and front side portions, a mechanical fitting is formed the strength of which can be dimensioned and regulated.

Figure 6:
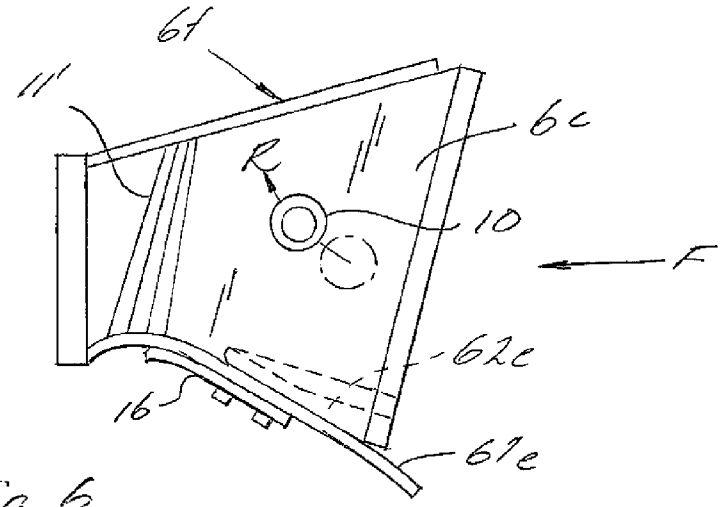
FIG. 6 shows the coupler head housing in FIG. 5 in compressed state.

As long as the shape of the coupler head housing at traction or thrust forces occurring during normal operation remains unaffected, it will be appreciated that no mutual movement between the side portions 61*e* and 62*e* takes place. Upon occurrence of a compressive force that causes triggering of the compression of the coupler head housing within the deformation zone D1, typically resulting in a folding of the upper part and bottom of the coupler head housing along deformation notches such as schematically is illustrated in FIGS. 6 and 8, a mutual movement is forced between the side portions, which is counteracted by the friction in the prestressed mechanical joint.

In other words, the mechanical fitting provides a frictional force that, when it is overcome, triggers a deformation resistance that retards the compression of the coupler head housing, whereby a greater part of an applied compressive force can be absorbed in a controllable course of deformation than what can be achieved only by the plastic deformation of the coupler head housing.

In addition, the friction in the connection may be affected by particular friction-increasing elements 20, which may be flush mounted to act in the interface between sliding surfaces. Such a friction-increasing element 20 is suitably made from cemented carbide or from ceramic material and provided with a material-removing outside.

In an alternative embodiment (not shown), the rear side portion 61*e* is made as a wedge that, when compressing the coupler head housing, forces the mechanical fitting to widen while extending the bolts 14, 15, alternatively or in addition to simultaneous deformation of the thrust plate 16. Such an embodiment, based on a wedge, may be utilized in combination with measures to increase the friction between mutually sliding surfaces.

It will be appreciated that the coupler head housing in this case should be assembled in such a way that the compression of the upper part and bottom thereof can take place without essentially limiting the ability of the side portions to move in relation to each other in the connection area. For the purpose, the rear side portion 61*e* of the embodiment example is only to a limited extent connected with the upper part and bottom of the coupler head housing, and in particular in the area of the deformation zone D1 as well as in the overlapping area separated from, or by a frangible connection separable from, the upper part and the bottom. On the contrary, the front side portion 62*e* is preferably strongly connected with the upper part and bottom of the coupler head housing, such as by welding and/or screw fitting. Also the thrust plate 16 in the illustrated embodiment may be strongly connected with the upper part and bottom of the coupler head housing, at least in the part of the thrust plate 16 that is running parallel and in overlapping relationship with the front side portion 62*e*. It will be appreciated, without this being shown in the drawings, that the opposite relationship regarding the connection of the side portions to the upper part and the bottom, respectively, may be the case in an alternative embodiment of the coupler head.

Figure 5:
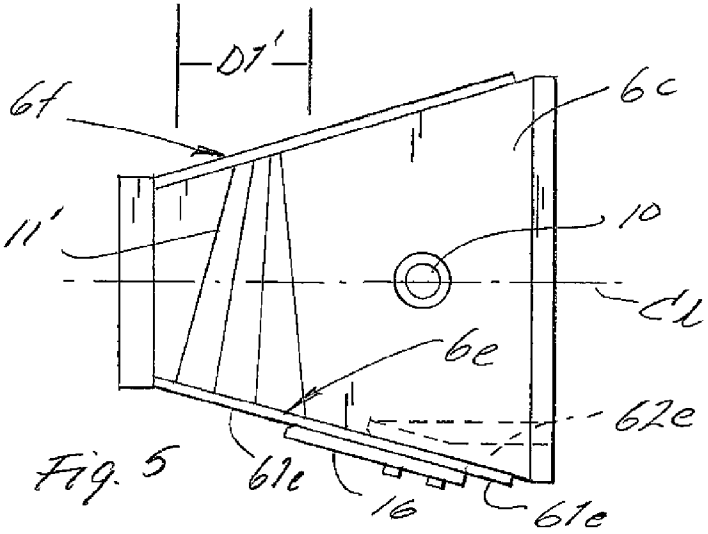
FIG. 5 shows in a horizontal view a second embodiment of a coupler head housing.

While the embodiment in FIGS. 1 and 2 have deformation notches 11 and 12 running mutually parallel and essentially perpendicular to the longitudinal axis C1 of the coupler head housing for a symmetrical compression of the coupler head housing, FIG. 5 shows an embodiment according to which deformation notches 11' run divergingly toward one side 6*e* of the coupler head housing. In this way, a deformation zone D1' is delimited the principal extension of which is displaced toward the side 6*e*. This embodiment results in an asymmetrical compression of the coupler head housing as is illustrated in FIG. 6. During the asymmetrical course of deformation, the bearing 10 of the coupling is moved in the direction of the arrow R toward the opposite side 6*f*, which in this embodiment may be arranged to arrest the coupling and prevent the rotation thereof toward a disengaging state. For instance, the side 6*f* may for this purpose be formed with a bulging on the inside thereof, against which the central plate is brought into mechanical engagement by movement in the direction R.

The embodiment according to FIGS. 7-8 is, like the coupler head housing in FIGS. 1-2, arranged for a symmetrical compression and has for the purpose two groups of deformation notches 11', which run divergingly in opposite directions toward a respective side portion 61*e* and 61*f*. During the symmetrical course of deformation, the bearing 10 of the coupling is moved in the direction of the arrow L and in the longitudinal direction C1 of the coupler head housing, without the mutual relative position of the coupling components being affected by the compression of the coupler head housing.

Even if the invention hitherto has been explained based on schematically shown embodiments, it is appreciated that the same may be realised in other embodiments than the shown, geometrically box-shaped coupler head housing having essentially plane surfaces. More precisely, the upper part, the bottom as well as the sides may be designed with bulging surfaces, which particularly in respect of the mutually displaceable side portions may be utilized to give the same a greater stiffness in the direction of their motion in the course of deformation. Furthermore, it is feasible that the parts of the coupler head housing are made from different materials, such as metal and light metal or alloys thereof. Also polymeric materials may be considered for parts of the coupler head housing.

FIGS. 9*a* and 9*b* show the invention realised in a productional embodiment example. The coupler head housing in FIGS. 9*a* and 9*b* is suitably produced by cutting and bending of steel plate for the formation of two essentially uniform parts, which are assembled into a box-shaped unit. The sides 6*e* and 6*f* of the coupler head may at least partly be formed by bending an originally plane or compression-moulded blank into an upper part and a bottom, respectively, with supplementing parts attached by welding. The upper part and the bottom may finally be united by a horizontally running welding seam.

The coupler head according to FIGS. 9*a* and 9*b* comprises a rear part, which carries an attachment 21 for a drawbar, as well as a front part, which carries a front plate 22 having a guide cone 7, as well as a seat 23 for the bearing of the shaft of the coupling mechanism. The front and rear parts of the coupler head housing are united by a deformation zone D1 in the form of transverse bendings in the upper part 6*c* and bottom 6*d*, respectively, of the coupler head housing (see FIG. 9*b*), which bendings form notches 11 for the axial compression of the coupler head housing by folding. As may be best seen in FIG. 9*b*, the side portions 61*e* and 61*f*, which connect to the rear part of the coupler head housing, extend forward toward the front plate 22 and more precisely outside and partly in overlapping relationship with the side portions 62*e* and 62*f*, respectively, which connect to the front part of the coupler head housing. From the overlapping area, the side portions 62*e* and 62*f* extend divergingly up to the front plate 22. A side beam 24 having a U-shaped cross-section surrounds the side portions from outside and is only in a front end fixedly connected with the front part of the coupler head housing, but lacks anchorage to the rear part of the coupler head housing. A recess 25 is formed in the sides of the U-beam right in front of the deformation zone to allow folding and expansion of the upper part and the bottom within the deformation zone D1. For the same purpose, the side portions 61*e* and 61*f* may be connected with the upper part and the bottom only in the area outside, or behind, the deformation zone. Upon application of a deforming compressive force against the coupler head housing in FIGS. 9*a* and 9*b*, energy is absorbed on one hand by folding of the deformation zone and on the other hand by the bending of the side portions 61*e*, 61*f* that is forced when the same while bending are displaced along the diverging extension of the side portions 62*e* and 62*f*, respectively.

Figure 10:
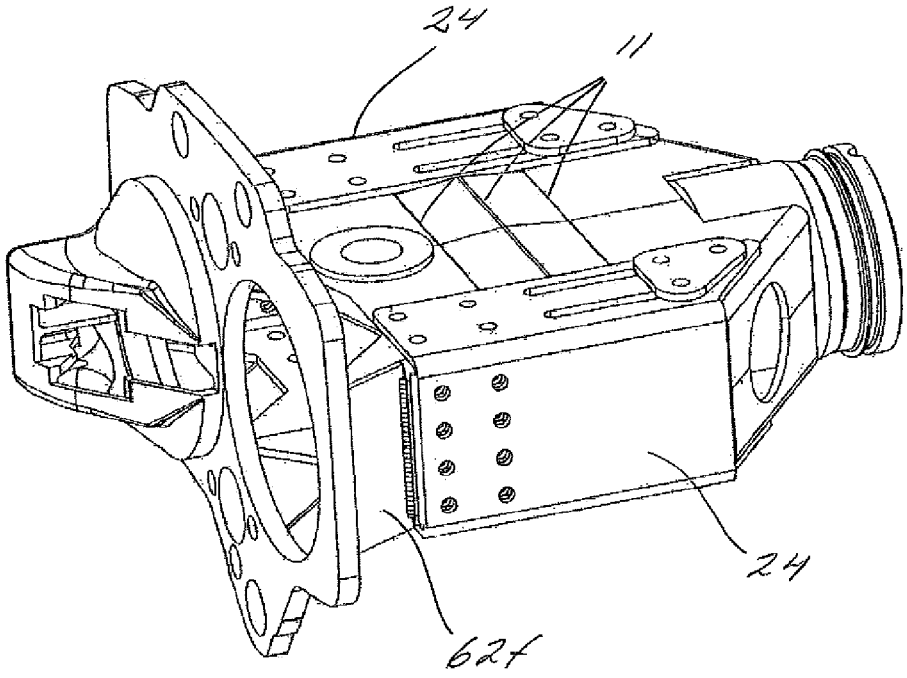
FIG. 10 shows a preferred alternative embodiment of the coupler head housing according to FIGS. 9*a*-9*b*.

In addition, between the side beam 24 and the side portion 62*e*/62*f*, a frictional force may be provided that retards the motion of the intermediately supported side portion 61*e*/61*f*. For this purpose, such as in the embodiment according to FIG. 10, the side beam 24 and the side portion 62*e*/62*f* can cooperate in a mechanical joint essentially in the way described above with reference to, among others, FIG. 4.

Figure 11:
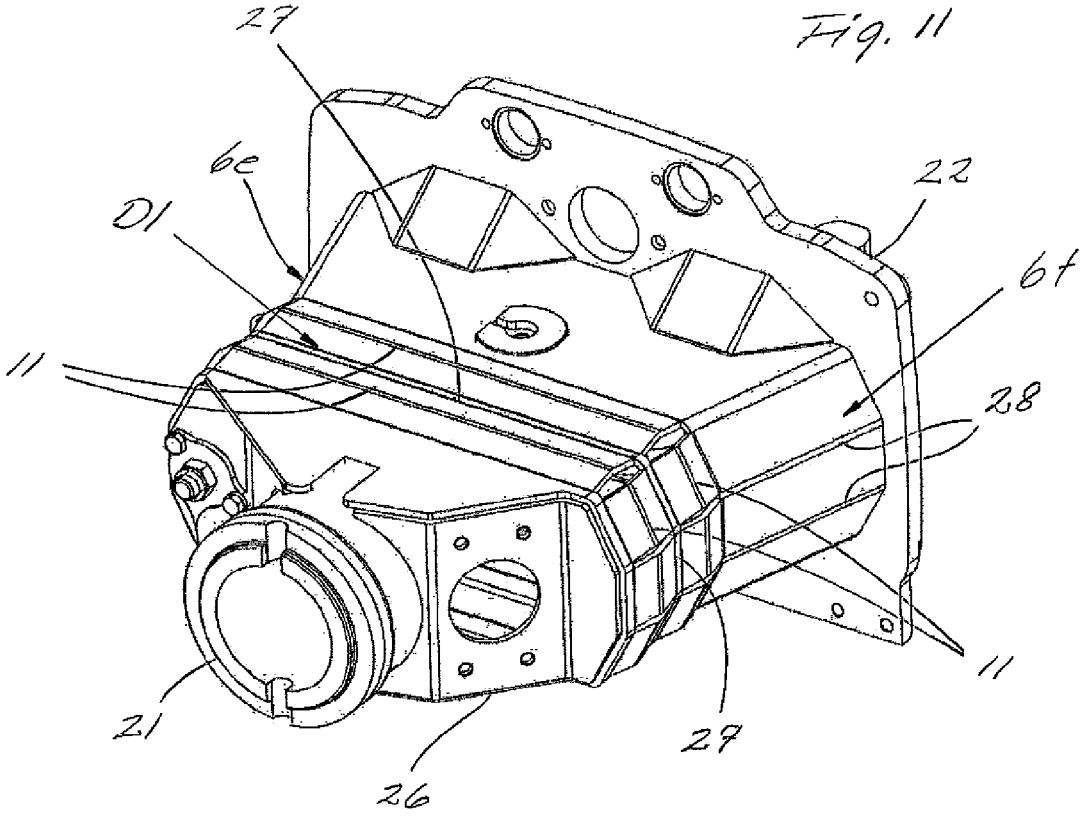
FIG. 11 shows an additional preferred embodiment of a shock-absorbing coupler head according to the invention.

Another preferred embodiment of the shock-absorbing coupler head is shown in FIG. 11. In this embodiment, the coupler head housing comprises a back piece 26 included as a part of the rear part of the coupler head housing. The back piece 26 may be produced, for instance, by cutting and bending and/or compression-moulding of a steel plate blank. In the back piece, an attachment is arranged for a drawbar, which attachment is in the form of a pipe sleeve 21 traversing the back piece. From the back piece, the upper part, bottom and sides of the coupler head housing extend forward to the front plate 22. Also these may be manufactured by cutting and bending and/or compression-moulding of one or more steel plate blanks, which, where appropriate, are assembled, preferably by welding. Between a rear part and a front part of the coupler head housing, a circumferential deformation zone D1 is arranged in the form of transverse bendings in the upper part, bottom as well as sides of the coupler head housing, which bendings form notches 11 for the axial compression of the coupler head housing by folding. More precisely, the embodiment according to FIG. 11 comprises two or more folding zones running in parallel at which the sheet-metal plate in the upper part, the bottom and the sides is bent outward. Even if the bulgings of the embodiment example are V-shaped, it is appreciated that these nevertheless may have another shape, and for instance comprise several steps, or be continuously arc-shaped.

Between the bulging folding zones, connecting portions 27 run, which extend through the corner connections between the sides and the upper part and bottom, respectively, of the coupler head housing, and which delimit those slots in the corner areas that in the embodiment shown have been recessed to allow a uniform and controlled deformation of the coupler head housing.

From the deformation zone D1, the sides 6*e* and 6*f* of the coupler head housing extend divergingly forward toward the front plate 22. The sides 6*e*, 6*f* may advantageously be made with one or more longitudinal bendings 28, which contribute to increased axial stiffness of the front part of the coupler head housing.

In one embodiment of the coupler head housing according to FIG. 11, the deformation zone D1 may in a meritorious way be produced by compression-moulding of a steel plate blank, which then is installed in the coupler head housing by welding.

The shock-absorbing coupler head may advantageously be utilized in combination with other shock-absorbing means in the coupling arrangement, such as deformation tubes and/or resilient devices, known per se. In that connection, the shock-absorbing members of the coupling arrangement are suitably adapted in such a way that all are maximally utilized before a destructive force is initiated in the car chassis.

The invention claimed is:

1. Coupler head for a coupling arrangement, which coupler head comprises a coupler head housing extending in a longitudinal direction from a first end, attachable to a drawbar, to a second end, which is arranged to carry a coupling interface between coupled rail vehicles, which coupler head housing houses mechanical coupling components effective for automatic coupling to the corresponding components of a connecting coupling arrangement, characterized in that the coupler head housing is made with a notch (11; 11'; 12) for a predetermined and primarily axial compression thereof with absorption of energy from a deforming compressive force that is applied to the coupler head in the longitudinal direction thereof.

2. Coupler head according to claim 1, which coupler head has at least one notch (11; 11') for a predetermined folding of the coupler head housing.

3. Coupler head according to claim 2, wherein said at least one deformation notch (11; 11') defines a primary deformation zone (D1) situated behind the bearing of the mechanical coupling components (8-10) in the coupler head housing.

4. Coupler head according to claim 3, wherein an additional deformation notch (12) defines a secondary deformation zone (D2) situated in front of the bearing of the mechanical coupling components (8-10) in the coupler head housing.

5. Coupler head according to claim 1, wherein the coupler head housing comprises two opposite sides (6*e*, 6*f*) that are connected with an upper part (6*c*) and a bottom (6*d*), respectively, deformation notches (11, 11') being uniformly made at least in the upper part (6*c*) and bottom (6*d*) of the coupler head housing.

6. Coupler head according to claim 5, wherein deformation notches (11) through the upper part (6*c*), the bottom (6*d*) and the sides (6*e*, 6*f*) form a deformation zone (D1) surrounding the coupler head housing.

7. Coupler head according to claim 6, wherein the deformation zone (D1) consists of a compression-moulded steel plate blank installed in the coupler head housing by welding.

8. Coupler head housing according to claim 6, wherein the sides (6*e*, 6*f*) of the coupler head housing run divergingly from the deformation zone (D1) toward a front plate (22) carried in the front end of the coupler head housing.

9. Coupler head according to claim 5, wherein the deformation notches (11') are asymmetrically arranged in the upper part (6*c*) and bottom (6*d*), respectively, of the coupler head housing.

10. Coupler head according to claim 9, wherein the deformation notches (11') define a deformation zone (D1'), which diverges toward one side of the coupler head housing.

11. Coupler head according to claim 9, wherein the deformation notches (11; 11') are made to create a greater compression in the side (6*e*) of the coupler head housing closest to which the coupling link (9) of the coupling mechanism is situated.

12. Coupler head according to claim 11, wherein the coupler head housing, by an asymmetrical course of compression, is arranged to provide a locking of the mechanical coupling components (8, 9) in the coupled state by the central plate (8) being brought into engagement with the side (6*f*) of the coupler head housing.

13. Coupler head according to claim 1, wherein the coupler head housing in addition comprises a means that is introduced in the structure thereof and is detached from the deformation zone (D1) and that provides an added deformation resistance in the course of deformation.

14. Coupler head according to claim 13, wherein said means is made in a side of the coupler head housing in the form of bending, or by a material thickness varied locally in said side.

15. Coupler head according to claim 13, wherein said means comprises mutually detached parts (61*e*, 62*e*; 61*f*, 62*f*) of the side of the coupler head housing, which are individually connected with the coupler head housing but mutually movable and, upon mutual displacement, cause a bending of at least one of the parts (61*e*, 61*f*) of the side.

16. Coupler head according to claim 13, wherein said means is arranged to provide a frictional resistance while overcoming a prestressing force acting between mutually movably connected parts (61*e*, 62*e*; 61*f*, 62*f*) of the side of the coupler head housing.

17. Coupler head according to claim 1, wherein the coupler head housing has, in at least one side (6*e*, 6*f*), a first side portion (61*e*, 61*f*), which under prestress is fixed by clamping against an overlapping area of a second side portion (62*e*, 62*f*) of said side (6*e*, 6*f*) of the coupler head housing.

18. Coupler head according to claim 17, wherein the side portions (61*e*, 62*e*; 61*f*, 62*f*) are interconnected in the overlapping area by means of a controlled tightenable bolt joint (14, 15, 16).

19. Coupler head according to claim 17, wherein friction-increasing means (20) is introduced between the side portions (61*e*, 62*e*; 61*f*, 62*f*) in said overlapping area.

20. Coupler head according to claim 1, which has a deformation notch (11, 11', 12) formed by means of a relative weakening locally applied in the coupler head housing and comprising one or more of the measures compression-moulding, bending, milling, hole making, varied material thickness, local hardening, combination or combinations of different materials, material composition, or addition of material.

* * * * *